US009489929B1

(12) United States Patent
Armstrong

(10) Patent No.: US 9,489,929 B1
(45) Date of Patent: Nov. 8, 2016

(54) TUNING APPARATUS AND METHOD FOR ELECTRIC GUITAR EQUIPPED WITH A TREMOLO SYSTEM

(71) Applicant: Dennis Armstrong, Brick, NJ (US)

(72) Inventor: Dennis Armstrong, Brick, NJ (US)

( * ) Notice: Subject to any disclaimer, the term of this patent is extended or adjusted under 35 U.S.C. 154(b) by 0 days.

(21) Appl. No.: 14/999,784

(22) Filed: Jun. 27, 2016

(51) Int. Cl.
*G10D 3/12* (2006.01)
*G10D 1/08* (2006.01)
*G10D 3/14* (2006.01)

(52) U.S. Cl.
CPC ..... *G10D 3/12* (2013.01); *G10D 1/085* (2013.01); *G10D 3/146* (2013.01)

(58) Field of Classification Search
CPC ..... G10D 3/12; G10D 3/146
See application file for complete search history.

(56) References Cited

U.S. PATENT DOCUMENTS 5,589,653 A * 12/1996 Rose ..... G10D 3/14 84/297 R
5,700,965 A * 12/1997 Rose ..... G10D 3/10 84/199
5,705,760 A * 1/1998 Rose ..... G10D 3/14 84/199
5,717,150 A * 2/1998 Rose ..... G10D 3/14 84/297 R

* cited by examiner

*Primary Examiner* — Robert W Horn
(74) *Attorney, Agent, or Firm* — Clifford G. Frayne

(57) ABSTRACT

An improved tuning and tensioning apparatus for an electric guitar equipped with a tremolo system, the plurality of guitar strings being tensionly secured between the tremolo bridge and a combination lug guide/nut secured below the headstock of the guitar, the strings secured in the lug guide/nut to a plurality of heaving lugs, each An improved tuning and tensioning apparatus for an electric of the heaving lugs being rigidly secured to a tension post on the headstock, the tension post being rotatable by a selective tensioner, thus allowing the musician to retune and retension the guitar strings in an uninterrupted manner while playing the guitar and utilizing the tremolo system.

17 Claims, 8 Drawing Sheets

TUNING APPARATUS AND METHOD FOR ELECTRIC GUITAR EQUIPPED WITH A TREMOLO SYSTEM

BACKGROUND OF THE INVENTION

1. Field of the Invention

The present invention relates to electric guitars, and in particular, electrical guitars which incorporate a tremolo system, which includes a tremolo bar, which selectively, temporarily acts on the guitar strings to allow the musician to achieve a descending or ascending note. Applicant's apparatus and method allows a musician to selective and continuously maintain, adjust or correct the tension of the guitar strings while performing or practicing with a tremolo system by being able to utilize the tuning tensioners at the headstock of the guitar neck 2. Description of the Prior Art Electric guitars are very popular and a variety of electric apparatus have been developed which allow for the sound modification of electric guitars. This allows musicians to create sounds that were previously obtainable only in recording studios or through the use of very expensive sound equipment.

On a typical guitar, the strings, usually six in number, are tensioned between the bridge of the guitar, which is normally positioned on the rear end of the guitar body, and the tuning tensioners and take up posts, or tuning machines as they are sometimes referred to, positioned on the headstock at the end of the neck of the guitar. In this form of guitar, the musician would adjust the tensioners to achieve the desired tension of a particular string.

A tremolo system was further introduced to electric guitars, which allows the musician to selectively achieve descending notes or ascending notes as desired by either pressing downwardly on the tremolo bar or pulling upwardly on the tremolo bar from the tremolo bars neutral position.

In essence, the tremolo system replaces the bridge of the guitar positioned at the rear end of the guitar body. The strings are attached to a locking saddle in the bridge of a tremolo system, which in turn is secured to a tensioning helical spring positioned within the guitar body. The movement of the tremolo bar affects the tensioning of the six guitar strings.

The early tremolo systems suffered from the fact that the use of the tremolo bar, more often than not, would affect the tuning of the strings. The early tremolo systems used what is referred to in the trade as a nut. It was essentially a transverse bar at the end of the neck of the guitar having six spaced apart grooves there through accommodating one each of the strings of the guitar, which after passing through the grooves of the nut, where then redirected to the tuning tensioners and posts, or tuning machines. All guitars, whether having a tremolo system, utilize a nut that establishes the upper point of intonation of the guitar, the lower point of intonation being the bridge or tremolo bridge. Activation of the tremolo bar in the early systems would either tension or release tension on the strings to achieve the desired sound, but the return of the tremolo bar to its neutral position did not always insure that the actual guitar strings would return to their desired, preset prior tension.

Over the years a locking system was devised to address this problem. It is referred to in the trade as a double locking tremolo system. In it, the guitar strings are mechanically clamped at both points of intonation, that is at the headstock where the nut is positioned and at the bridge of the tremolo bar in a locking saddle.

The drawback to this system was that the strings on the nut proximate the headstock of the guitar locked the strings in position and disallowed the musician the ability to adjust tension using the tuning tensioners or tuning machines on the headstock. The system did include an adjustment means on the locking saddle of the bridge at the base of the tremolo system, however, the adjustment using this intonation position was very minor and did not allow the musician the range or travel for correction of the tension. The only recourse was to loosen and then retighten the clamps on the locking nut to allow the musician to use the tuning tensioners or tuning machines on the headstock. This is something not easily accomplished during a performance or practice or tuning.

Applicant has developed an apparatus and system which allows the musician to adjust the tension on the guitar strings independently and while performing without resorting to tools to loosen and retighten clamps, etc. It is now locking yet allows excess use of the tremolo system without going out of tune.

Objects of the Invention

An object of the present invention is to provide for a novel tuning apparatus and system for use with electric guitars equipped with tremolo systems.

A still further object of the present invention is to provide for a novel tuning apparatus and system for permitting the musician to selectively and continuously adjust the tension of the strings of the electric guitar while performing and utilizing a tremolo system.

A still further object of the present invention is to provide for a novel tuning apparatus and system for tuning the strings of an electric guitar which incorporates a tremolo system, which apparatus can be original equipment on such electric guitar, or can be retrofit to existing electric guitars.

A still further object of the present invention is to provide a tuning apparatus and system for electric guitars utilizing a tremolo system which allows the musician a greater range of adjustment of the tension of the strings than previously provided by earlier fine tuning tremolo systems.

SUMMARY OF THE INVENTION

An improved tuning and tensioning apparatus for an electric guitar equipped with a tremolo system, the plurality of guitar strings being tensionly secured between the tremolo bridge and a combination lug guide/nut secured below the headstock of the guitar, the strings secured in the lug guide/nut to a plurality of heaving lugs, each An improved tuning and tensioning apparatus for an electric of the heaving lugs being rigidly secured to a tension post on the headstock, the tension post being rotatable by a selective tensioner, thus allowing the musician to retune and retension the guitar strings in an uninterrupted manner while playing the guitar and utilizing the tremolo system.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
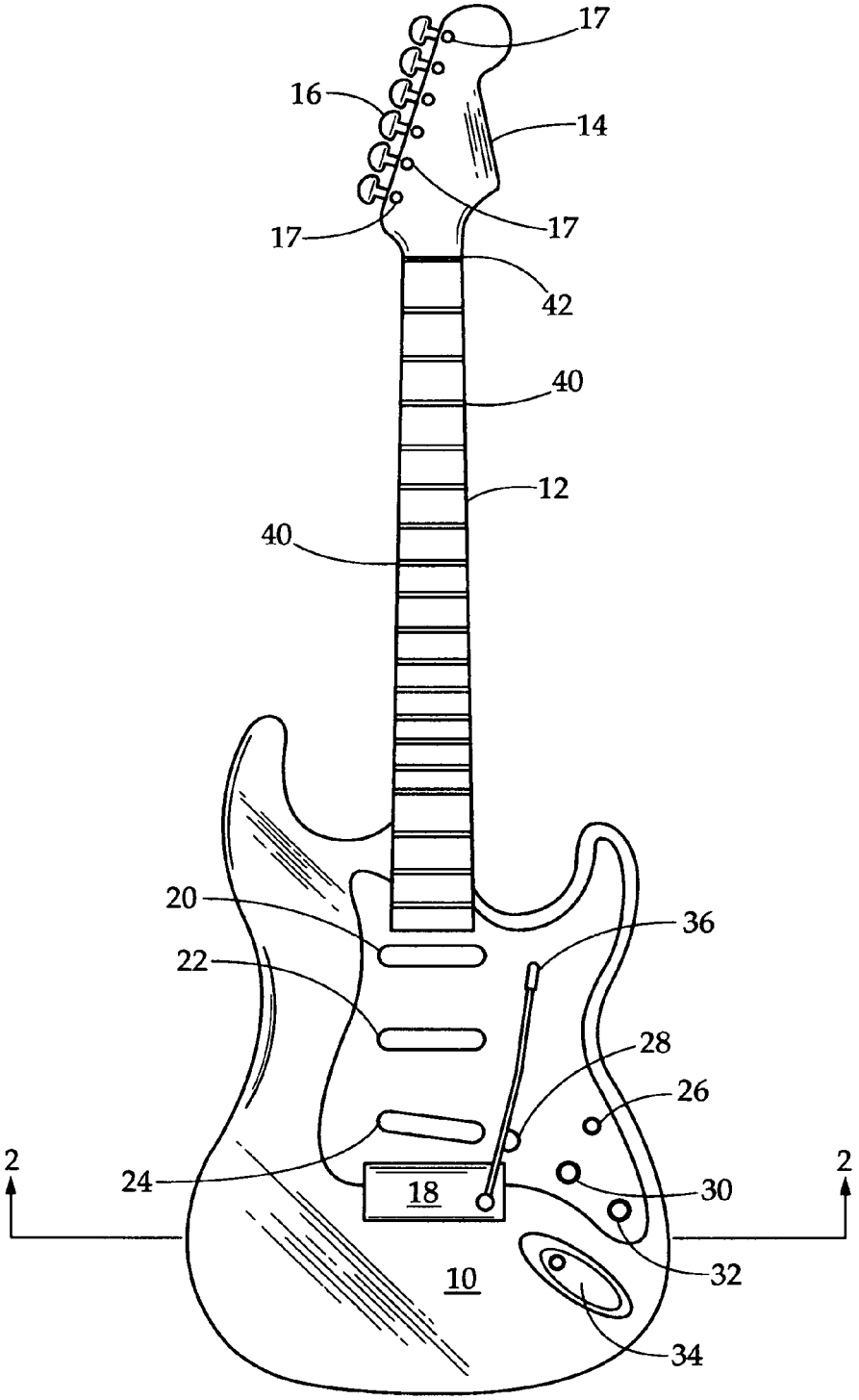
FIG. 1 PRIOR ART
FIG. 1 is a front view of a typical electric guitar with tremolo bar of the prior art.

FIG. 1 is a front view of a typical electric guitar. It consists of a body 10, neck 12, headstock 14, which include a plurality of tensioners 16 and associated posts 17, and a plurality of strings (not shown), which extend from the tensioners to a tremolo bridge 18. The guitar body would also include a plurality of pick ups 20, 22, and 24. Additionally, the electric guitar might contain a selector switch 26 and a volume dial 28 and tone dials 30 and 32, and a signal output receptacle 34 into which the electrical conduit from an amplifies is plugged.

The guitar depicted in FIG. 1 also contains a tremolo bar 36. The guitar depicted in FIG. 1 illustrates the tremolo bar in its earliest configuration for use with an electric guitar. It includes the bar 36 and a bridge 18. The guitar strings would be secured to the bridge 18, and then extend up the neck 12 to the tensioners 16. The various parallel ridges on the neck 12 are identified as frets 40 which serve as guides for the fingers of the musician. The uppermost fret closest to the headstock 14 was commonly referred to in the trade as the nut 42. It consisted of a raised ridge having a plurality of grooves 43 (See FIG. 3) formed there through as described hereafter, each groove associated with a particular string stretching from the respective tensioner 16 to the tremolo bridge 18. The nut 42 serves as the upper intonation point for sounds and the tremolo bridge 18 serves as the lower intonation point for sound caused by the vibration of the strings when played.

Figure 2:
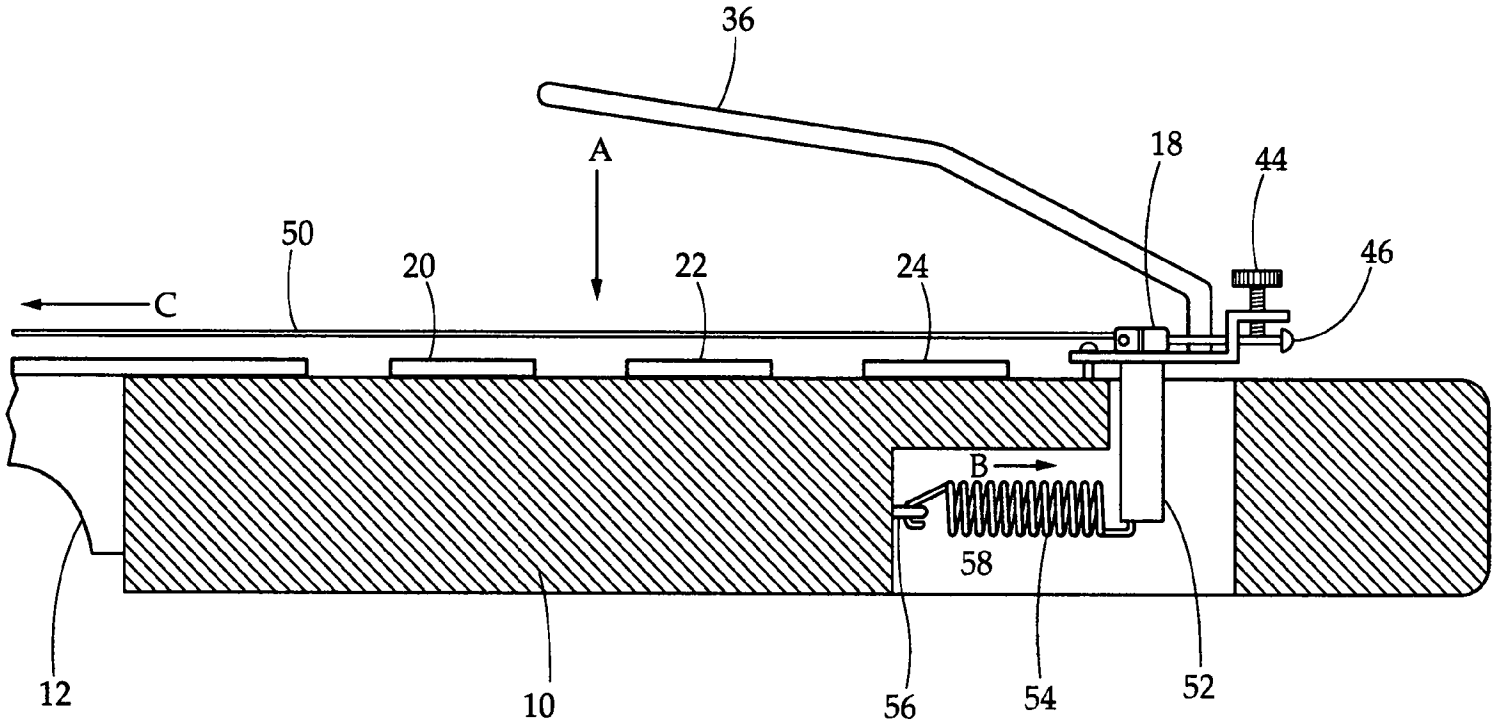
FIG. 2 PRIOR ART
FIG. 2 is a side cutaway view of the guitar of FIG. 1 along Plane 2-2 illustrating the tremolo bar structure.

FIG. 2 is a side cutaway view of an electric guitar utilizing a tremolo system along Plane 2-2 of FIG. 1 illustrating the basics of a tremolo system which encompasses and includes a fine tuner 44 and clamping screw 46 associated with the tremolo bridge 18 to allow for adjustments of strings 50 as more fully discussed hereafter. The basics of the tremolo bar are the tremolo bar 36 secured to the tremolo bridge 18, the tremolo bridge 18 is connected to a vertical pivot arm 52 extending inwardly into the body 10 of the guitar where it is secured to a biasing means 54 in the form of a coil spring which is secured to the vertical pivoting arm 52 and to a fixed point on the interior 58 of the guitar body 10. In this configuration if the tremolo bar 36 is moved downwardly, that is towards the body 10 of the electric guitar (arrow A), the biasing means or coil spring 54 is longitudinally extended (arrow B), thus creating lesser tension on the strings 50 of the guitar (arrow C), thus trapping string tension between the nut 42 and tension posts 17. If the tremolo bar 36 is pulled away from the body 10 of the guitar, the amount of tension on the strings 50 is greater because of the pivot mechanism returning the biasing means or coil spring 54 to a lesser length, thus trapping string tension between the nut 42 and the tremolo bridge 18.

Figure 3:
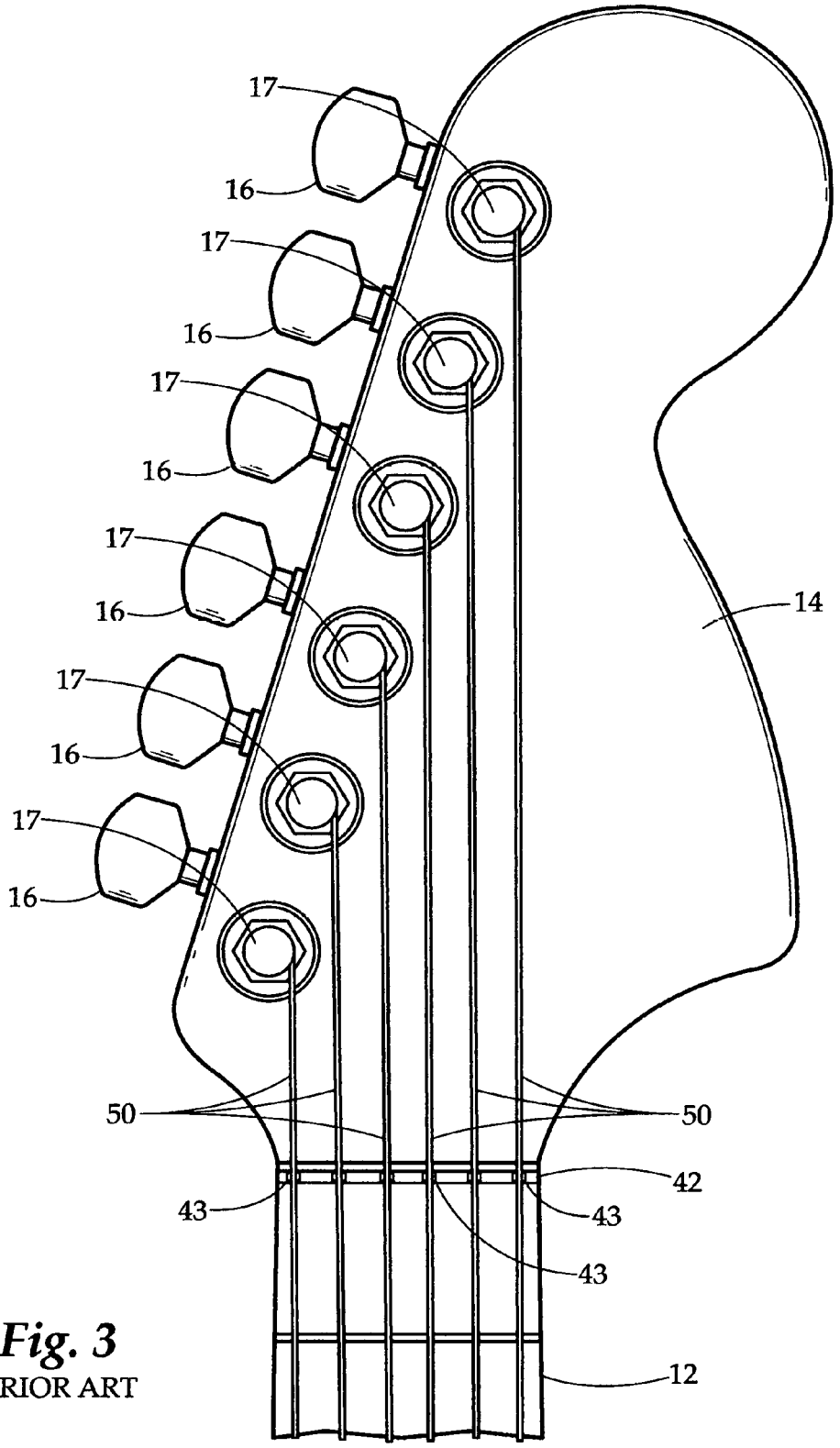
Fig. 3 PRIOR ART
FIG. 3 is a close up front view of the headstock of an electric guitar which did not incorporate a locking nut.
Figure 4:
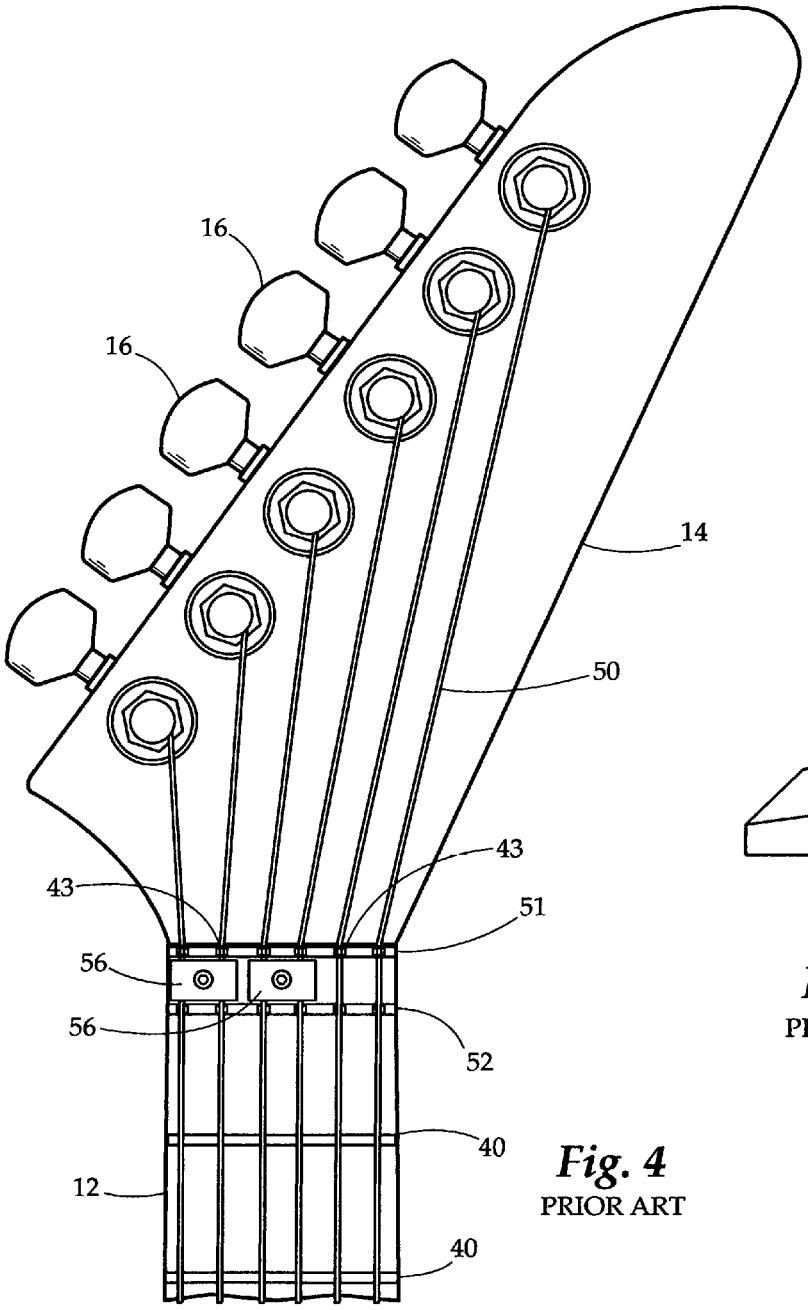
Fig. 4 PRIOR ART
FIG. 4 is a close up view of a headstock incorporating a locking nut of the prior art.
Figure 5:
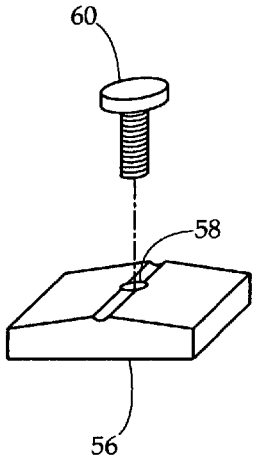
Fig. 5 PRIOR ART
FIG. 5 is a perspective view of the clamp utilized in the locking nut of the prior art.

In the earliest version of the tremolo bar, the lower end of the strings 50 would be attached directly to the tremolo bridge 18 with no provision for tensioning the strings at the bridge end. As stated and illustrated in FIG. 3, the upper ends would be secured across the nut 42 and to a respective tensioner 16. The initial intention with the tremolo bar system was that in an ideal situation the strings would return to their set tension when the tremolo bar 36 was positioned in a neutral position. However, this was not the case, and as such that the tremolo bar system evolved into a second generation system. The second generation system is illustrated in FIG. 2 with the introduction of a clamping screw 46 and a knurled fine tuner adjustment 44 which allowed for minor adjustment of the tension of a respective string. This became necessary because of the introduction of a further version of the tremolo bar system comprising a nut 42 which is now transformed into a locking nut system as illustrated in FIGS. 4 and 5. In FIG. 3, it is illustrated that the tensioners 16 are associated with a separate string 50 of the guitar, and the strings 50 will pass through nut 42 having a plurality of grooves 43 there through.

In the second version as illustrated in FIG. 4, a locking system was developed in which the nut 42 comprises two spaced apart ridges 51 and 52 having aligned grooves 43 for the passage there through of strings 50. However, this second generation nut has apertures alignable with bores in the neck of the guitar which allows for a series of clamps 56, which in the case illustrated comprises three clamps, to be secured over the strings 50 and lock the strings 50 into a desired tension as they pass through the spaced apart ridges 51 and 52. The clamps 56 consist of a block of steel having a central bore 58 there through for receipt of a threaded fastener 60 which would pass through the nut and into a bore in the locking nut frame locking the clamp in position preferably over two strings, there being three clamps to accommodate all six strings.

This clamping system as illustrated in FIG. 4 eliminated the musician's ability to use the tensioners 16 to adjust tension on the strings while playing the instrument and possibly utilizing the tremolo bar. This limited the musician to use the clamp and fine tuner in association with the tremolo bridge to allow the musician some degree of adjustment while performing (See FIG. 3). However, the amount of adjustment available to the musician through use of the fine tuner on the tremolo bridge is minimal and does not approach the amount that the musician would usually have using tensioners 16. This represents the present development of the tremolo bar system for electric guitars. There has been a need to improve the system to allow a musician the free use of the tremolo bar in acquiring or achieving a desired sound or note. However, the need also requires that the musician be allowed to adjust the tension on the strings while performing in the event that they become out of tune. Applicant's device as illustrated hereafter provides this ability to variations to the tremolo system as they exist.

Figure 6:
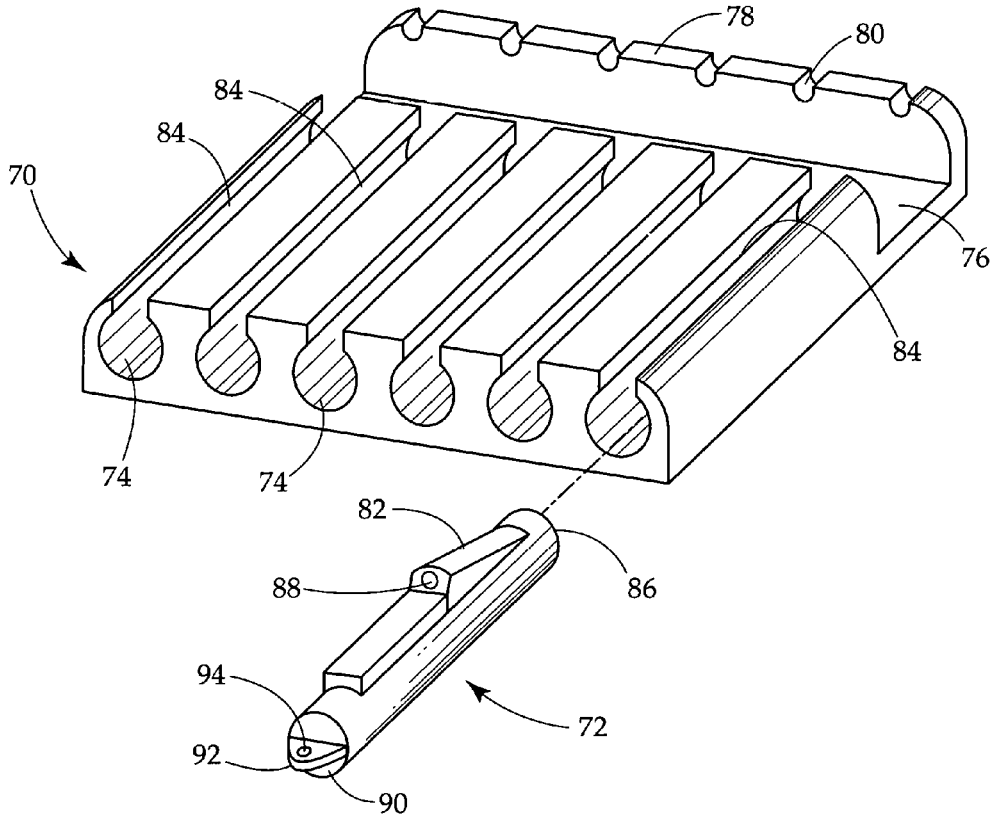
FIG. 6 is a perspective view of a lug guide and heaving lug which would replace the locking clamp.

FIG. 6 is a perspective view of the improvement Applicant has made to the tuning apparatus and method for use with an electric guitar equipped with a tremolo system. Applicant's improvement is directed to the neck, and in particular, the locking nut portion of the neck, and the headstock and tensioners. FIG. 6 illustrates a lug guide/nut 70 and heaving lug 72 slidably receivable within the lug guide/nut. There would be one heaving lug associated with each string 50 of the guitar and a lug guide/nut receptacle 74 for each heaving lug. The lug guide/nut would be formed with throughbores (not shown) in the base 76 of the lug guide/nut for securing the lug guide/nut to the bores in the neck of the guitar which previously secured the locking nut. The lower or bottom end of the lug guide/nut would resemble a portion of a locking nut in that it would consist of a raised ridge 78 extending upwardly from the base 76 of the lug guide/nut 70, the raised ridge 78 having a plurality of grooves or notches 80 formed there through along its upper surface for guidance and receipt of the strings 50 of the guitar, there being one groove or notch 80 associated with each heaving lug 72.

The heaving lug 72 itself is generally cylindrical in shape having an upstanding fin portion 82. The heaving lug is slidably receivable into the lug receptacle 74 of the lug guide/nut 70. Each heaving lug receptacle 74 has a slot 84 longitudinally formed along its upper cylindrical surface for acceptance of the heaving lug fin 82 which slidably positions itself within the slot as the heaving lug is positioned within the heaving lug receptacle 74. This prevents the twisting or turning of the heaving lug 72 within the heaving lug receptacle 74. The lower end 86 of the heaving lug 72 contains a bore 88 which extends into the heaving lug and extends and exits proximate the top of the heaving lug fin. The opposing end 90 of heaving lug 72 has secured thereto an arm 92 having an aperture 94 there through for connection to a tensioning rod as more fully explained hereafter.

Figure 7:
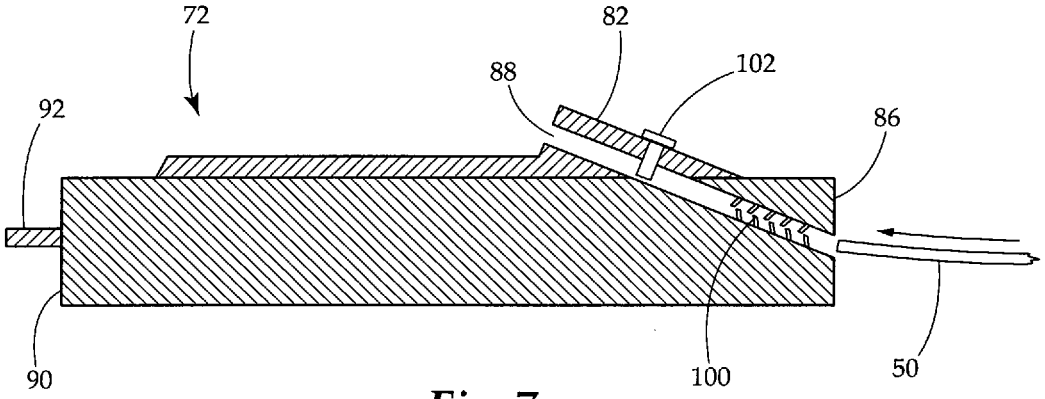
FIG. 7 is a side partial perspective cutaway view of the heaving lug of FIG. 6.

FIG. 7 is a side partial perspective cutaway view of the heaving lug of the present invention. The aperture and bore formed in the heaving lug extends from the lower face 86 to the heaving lug fin 82 at which point it exits and is angled upwardly and dimensioned to receive a string 50 of a guitar. It should be pointed out that on an electric guitar, the strings vary in diameter and some strings are of a narrower diameter than other strings depending upon the type of notes they are intended to play. Therefore, the dimension of the bore within the heaving lug may vary from heaving lug to heaving lug depending upon which string it is associated with. Or, it could be of a common diameter in order to accept the dimension of any string associated with the guitar. The purpose of the bore within the heaving lug is to receive a guitar string 50 as illustrated in FIG. 7. The bore is also intended to grasp and secure the guitar string once inserted. To that end, two different securing means are available that could work separately or in conjunction with each other. The first method is a series of teeth 100 angularly positioned within the bore 88, such that upon the insertion of the guitar string 50 through the bore it can be grasped by the fingers or by a plier and pulled tautly such that the angularly positioned teeth grasp the string and prevent it from being pulled backwardly through bore 88. A second securing means which could be separate or work in conjunction with the angular teeth would be a set screw 102 positioned on the upper surface of the heaving lug or the heaving lug fin 82 and extending downwardly into the bore 88 which would frictionally engage string 50.

Figure 8:
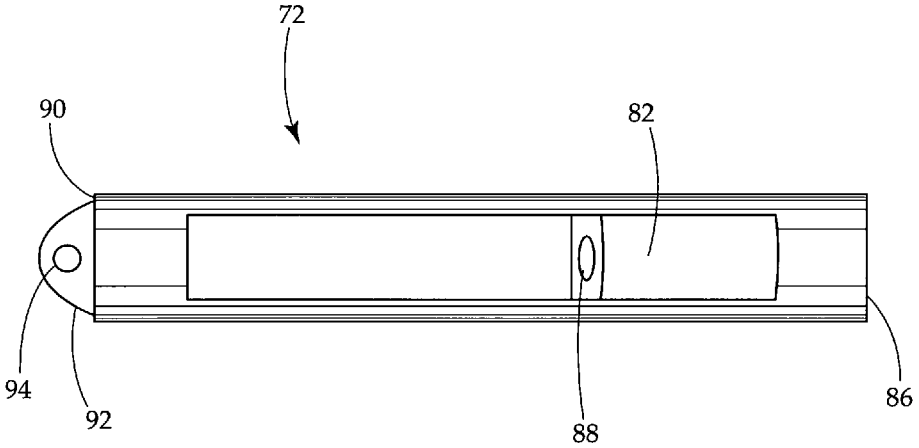
FIG. 8 is a top view of the heaving lug.

FIG. 8 is a top view of the heaving lug 72 illustrating the body of the heaving lug, the heaving lug fin 82, rear arm 92, and aperture 94 for securing the heaving lug to a tension rod, and the upper aperture of bore 88 through which the guitar string 50 would exit after insertion through the aperture in the lower end of the heaving lug.

Figure 9:
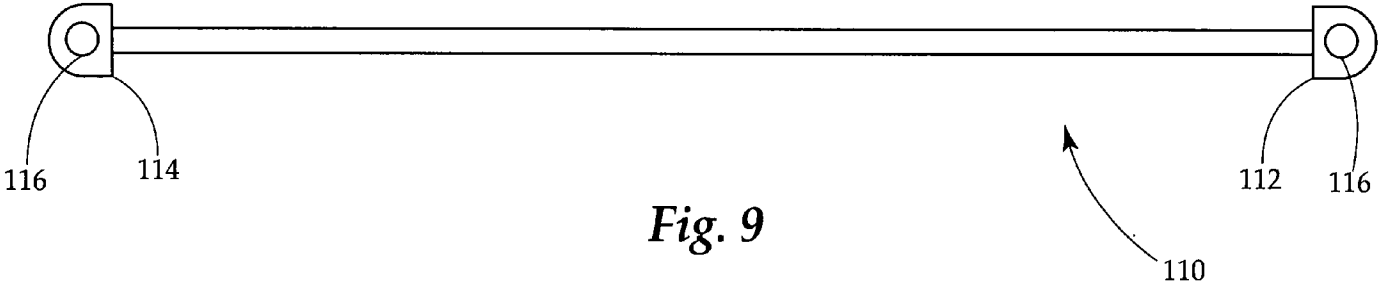
FIG. 9 is a top view of a pulling tyne connector of the present invention.
Figure 10:
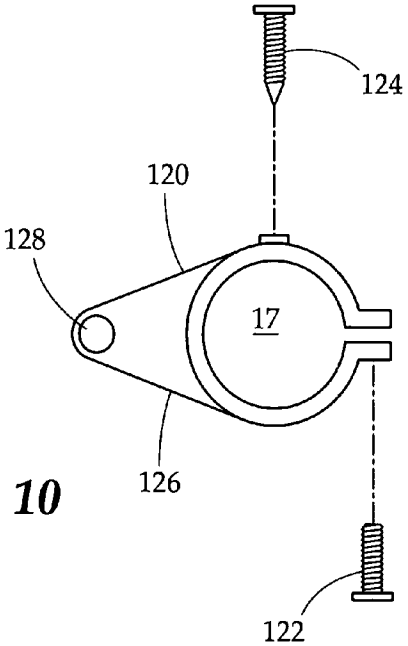
FIG. 10 is an exploded view of a clamping pivot arm of the present invention.

FIG. 9 is a top planar view of a tension rod or pulling tyne connector 110 utilized with each of the heaving lugs 72 and FIG. 10 is an exploded view of a clamping pivot arm for use in conjunction with the pulling tyne connector 110 and the tensioners 16 positioned on the headstock 14 of the electric guitar. The pulling tyne connector 110 is a rigid rod having a first end 112 and a second end 114, each end having an aperture 116 there through. One aperture at one end of the pulling tyne would be in contact with and removably secured to the arm 92 and aperture 94 at the upper end 90 of each of the heaving lugs 72 and the opposing end of the pulling tyne 110 would be secured to a clamping pivot arm 120 associated with each of the tensioners 16.

The clamping pivot arm as illustrated in FIG. 10 serves to clamp around individually, each of the upstanding posts 17 (See FIG. 1) associated with each tensioner. The clamping pivot arm 120 is secured about the post 17 by a threaded fastener 122 to provide a friction fit. It is also further secured by a set screw 124 necessary to provide further secure connection. The clamping pivot arm has an arm extension 126 having an aperture there through which allows the arm extension to be secured to a pulling tyne connector 110 end.

It is intended therefore that each heaving lug 72 slidably received within the lug guide/nut 70, has a guitar string 50 secured thereto and the upper end 90 of each heaving lug 72 is secured by means of a pulling tyne 110 directly to a clamping pivot arm 126 mounted on a post 17 on the headstock 14 which pivot arm is operated by the manipulation of the tensioners 16 on the headstock 14.

Since the tensioners extend upwardly along one side of the headstock 14, the pulling tynes 110 will necessarily be of varying lengths in order to provide for the differences in distance between their respective heaving lug 72 and its tensioner 16. Nevertheless, all of the heaving lugs are directly secured by a rigid pulling tyne 110 to a clamping pivot arm. Thus which each of the guitar strings firmly secured within their respective heaving lug 72, the guitarist can manipulate the tremolo bar to provide for the sounds desired by the musician and the musician is also allowed to correct the tension on the guitar string easily and effectively through use of the headstock tensioners 16 because the strings are no longer locked within the locking nut of the prior art, but are secured to a slidable lug nut which is rigidly secured to a clamping pivot arm which is secured to the post operated by the tensioners.

Figure 11:
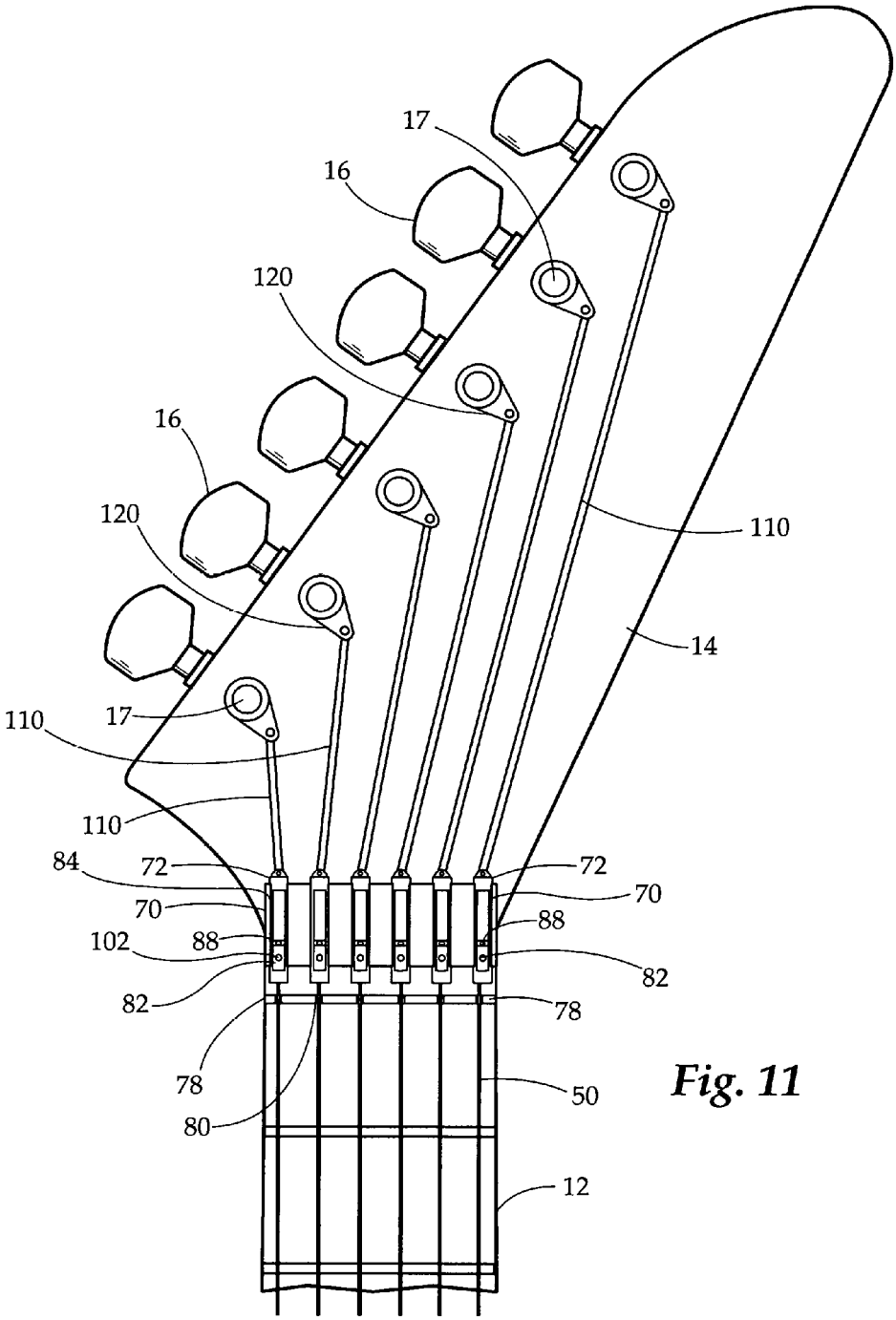
FIG. 11 is a front close up view of the headstock of an electric guitar incorporating a tremolo system, and which incorporates Applicant's tensioning apparatus and system.

FIG. 11 is a front close up view of the headstock 14, tensioners 16, and tension posts 17. FIG. 11 illustrates the installation of Applicant's tuning apparatus. The lug guide/nut 70 has been secured to the neck 12 of the guitar just below the headstock 14. Each individual heaving lug 72 has been inserted into its respective receptacle 74 with the lug fin 82 slidably extending through respective slots 84. The pulling tynes 110 have been secured to their respective heaving lug 72 and attached to pivot clamp 120 mounted on a respective tension post 17. The final step of the assembly involves the insertion of a respective guitar string 50 through a respective groove 80 in ridge 78, and thence its insertion into bore 88 on the heaving lug 72. When the respective guitar string has exited bore 88 through its aperture in fin 82, the guitar string 50 would be grasped by the fingers of the individual or by a pair of pliers and drawn tautly through bore 88. The angled barbs 100 within bore 88 would prevent the string from moving in the reverse direction, and once the guitar string had been thoroughly pulled through bore 88 such that end 86 of the heaving lug 72 were abutting ridge 78, the musician would then tighten the set screw 102 to further secure the string within bore 88. Any excess string at this point could be excised by scissors. In this fashion, the strings are secured to each respective heaving lug and each respective heaving lug is secured to a respective pivot clamp in association with each tensioner 16. The musician can then fine tune the strings by manipulating the tensioners and moving the heaving lugs and the secured guitar strings the desired distance to acquire the desired tension and note.

The original non-locking tremolo systems which are still in use and still manufactured today and is illustrated in FIGS. 1 and 3 has its advantages and disadvantages, as does the double locking tremolo system which was developed later than the original non-locking tremolo system and is illustrated in FIG. 4.

The original systems have the advantage of the stock or non-locking nut in that it permits the musician to use the tensioners to tune the machines at will without having to resort to additional tools to unlock the nut as required in the double locking tremolo system. The disadvantage is that when the tremolo system is used in the original non-locking tremolo system, the musician will end up more times than not with an unwanted trapping of string tension between the nut and the tuning posts or tuning machines, rendering the guitar out of tune.

The later double locking tremolo system has the advantage of the locking nut which allows the guitarist to use the tremolo system to excess, without rendering the guitar out of tune because the possibility of unwanted trapped string tension between the nut and the tuning machine is eliminated by the double locking system. The disadvantage is that you can no longer use the tuning machines at will unless you use tools to unlock the locking nut.

Applicant's invention incorporates the advantages of both and the disadvantages of neither in that there is no locking nut. The musician can always use the tuning machines at will, as well as use the tremolo system to excess without rendering the guitar out of tune because the possibility of unwanted trapped string tension between the nut and the tuning machines has been eliminated because the very guitar string itself between the nut and the tuning machine has been eliminated and replaced by Applicant's pulling tynes.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An improved tuning and tensioning apparatus for an electric guitar equipped with a tremolo system wherein the electric guitar has a guitar body, neck, headstock, tremolo bar, and tremolo bridge, tensioners and tensioning posts, and a plurality of guitar strings disposed between said tremolo bridge and said tensioning posts, said guitar strings passing through a nut on said neck of said guitar adjacent said headstock, said nut defining the upper intonation point of said guitar, said tremolo bridge defining said lower intonation point, said improved tuning and tensioning apparatus comprising:

a lug guide having an outer surface and an inner surface, said inner surface abutting said neck of said guitar below said headstock, said lug guide having an upstanding nut on its lower end, said nut having a plurality of grooves on an upper surface, said lug guide having a plurality of lug receptacles formed on its upper end, each said receptacle having an opening on said upper end for slidable insertion of a heaving lug, each such lug receptacle having a longitudinal slotted groove formed between said lug receptacle and said outer surface of said lug guide;

a plurality of heaving lugs, each heaving lug having a first lower end and a second upper end, and a longitudinal upper fin, each heaving lug slidably receivable within said lug receptacle, said upper longitudinal fin slidably received within said longitudinal slotted groove of said lug receptacle each heaving lug formed with a throughbore extending from a first lower end to said longitudinal upper fin for the insertion and frictional engagement of a guitar string passing over said nut and into said throughbore, said heaving lug having an extension arm for the removable receipt of a fastening rod positioned on a second upper end;

a plurality of pivot clamps, frictionally engageable with said tensioning posts formed on said headstock and associated with said tensioners, each of said pivot clamps having an arm extension for receipt of a fastening rod;

a plurality of fastening rods in the form of pulling tynes, removably securable between said second upper end of said heaving lugs and said extension arm of said pivot clamp.

2. The improved tuning and tensioning apparatus in accordance with claim 1 wherein said lug guide replaces said nut defining said upper intonation point, said lug guide is secured utilizing fastening bores of said nut in said neck of said guitar, said lower end of said lug guide now forming said upper intonation point of said guitar.

3. The improved tuning and tensioning apparatus in accordance with claim 1 wherein said heaving lug has a cross section complimentary with a cross section of said lug receptacle and is slidably insertable therein with said upper longitudinal fin cooperating with said longitudinal slotted groove in said lug receptacle preventing rotation of said heaving lug within said lug receptacle.

4. The improved tuning and tensioning apparatus in accordance with claim 1 wherein said throughbore in said heaving lug is angled upwardly from said front lower end of said heaving lug to said upper longitudinal fin and is formed with internal angled barbs for frictional engagement with said guitar string slidably inserted therein, said angled barbs preventing removal of said guitar string from said lower end of said heaving lug once inserted into said heaving lug.

5. The improved tuning and tensioning apparatus in accordance with claim 1 wherein said throughbore further has a set screw extending from said upper longitudinal fin or upper surface of said heaving lug into said throughbore to further engage and secure said inserted guitar string.

6. The improved tuning and tensioning apparatus in accordance with claim 1 wherein said plurality of pivot clamps are slidably engagable over a respective tension post and frictionally secured by a set screw.

7. The improved tuning and tensioning apparatus in accordance with claim 1 wherein said fastening rods in the form of pulling tynes are formed with a lower end and an upper end, each end having a fastening means for removably securing said pulling tyne to said extension arm of said heaving lug and said extension arm of said pivot clamp.

8. The improved tuning and tensioning apparatus in accordance with claim 1 wherein said fastening rods in the form of pulling tynes are of unequal length accommodating different distances between said lug guide and said pivot clamps on said tensioning posts, said tensioning posts being alignably positioned on said headstock.

9. The tuning and tensioning apparatus for an electric guitar equipped with a tremolo system, including tremolo bar and tremolo bridge, which permits the musician to tune and tension guitar strings in an uninterrupted manner while playing the guitar, and utilizing the tremolo system, the tuning and tensioning apparatus comprising:

a lug guide formed on a neck of said guitar adjacent a headstock, said lug guide having an outer surface and an inner surface, said inner surface abutting said neck of said guitar, said lug guide having a lower end defining a nut formed with grooves therein and serving as the upper intonation point of said guitar, said lug guide having a plurality of heaving lug receptacles formed in the body of said lug guide, said heaving lug receptacles having an insertion aperture in an upper end of said lug guide, each of said lug receptacles having a longitudinal slotted groove between said lug receptacle and said outer surface of said lug guide;

a plurality of heaving lugs slidably receivable within said lug receptacles of said lug guide, each of said heaving lugs having a lower end, an upper end, a longitudinal upper fin, a throughbore extending from said lower end of said heaving lug upwardly to said longitudinal fin of said heaving lug, and an extension arm formed on said upper end of said heaving lug;

a plurality of pivot clamps frictionally engaged to each of a plurality of tension posts, said tension posts positioned on said headstock of said guitar, each of said pivot clamps having an extension arm formed thereon for receipt of a fastening rod;

a plurality of fastening rods in the form of pulling tynes removably secured between said upper end of said heaving lug and said extension arm of said pivot clamp.

10. The tuning and tensioning apparatus in accordance with claim 9 wherein said lug guide replaces said nut defining said upper intonation point, said lug guide is secured utilizing fastening bores of said nut in said neck of said guitar, said lower end of said lug guide now forming said upper intonation point of said guitar.

11. The tuning and tensioning apparatus in accordance with claim 9 wherein said heaving lug has a cross section complimentary with a cross section of said lug receptacle and is slidably insertable therein with said upper longitudinal fin cooperating with said longitudinal slotted groove in said lug receptacle preventing rotation of said heaving lug within said lug receptacle.

12. The tuning and tensioning apparatus in accordance with claim 9 wherein said throughbore in said heaving lug is angled upwardly from said front lower end of said heaving lug to said upper longitudinal fin and is formed with internal angled barbs for frictional engagement with said guitar string slidably inserted therein, said angled barbs preventing removal of said guitar string from said lower end of said heaving lug once inserted into said heaving lug.

13. The tuning and tensioning apparatus in accordance with claim 9 wherein said throughbore further has a set screw extending downwardly into said throughbore to further engage and secure said inserted guitar string.

14. The tuning and tensioning apparatus in accordance with claim 9 wherein said plurality of pivot clamps are slidably engagable over a respective tension post and frictionally secured by a set screw.

15. The tuning and tensioning apparatus in accordance with claim 9 wherein said fastening rods in the form of pulling tynes are formed with a lower end and an upper end, each end having a fastening means for removably securing said pulling tyne to said extension arm of said heaving lug and said extension arm of said pivot clamp.

16. The tuning and tensioning apparatus in accordance with claim 9 wherein said fastening rods in the form of pulling tynes are of unequal length accommodating different distances between said lug guide and said pivot clamps on said tensioning posts, said tensioning posts being alignably positioned on said head stock.

17. A method of tuning and tensioning the strings of an electric guitar equipped with a tremolo system, wherein the tremolo systems comprises a tremolo bar and a tremolo bridge, said tremolo bridge forming said lower intonation point of said guitar, and said guitar is formed with an upper intonation point in the form of a nut secured between said neck of said guitar and said headstock of said guitar, the method comprising:

forming a lug guide having a body, said lower end of said lug guide body establishing the upper intonation point of said guitar in the form of a nut, the upper portion of said lug guide formed with a plurality of receptacles for the slidable receipt of a plurality of heaving lugs;

replacing said original upper intonation point nut of said guitar with said lug guide;

forming a plurality of heaving lugs, each heaving lug having a body, a lower end, an upper end, and a longitudinal fin formed thereon, each of said heaving lug slidably receivable within a plurality of said slidable lug receptacles;

inserting said heaving lugs into said lug guide receptacles;

securing pivot clamps on head stock posts associated with string tensioners;

securing a plurality of attachment rods in the form of pulling tynes removably securable to said upper end of said heaving lug and a respective said pivot clamp secured to said selective post of said tensioners on said headstock, thereby establishing a rigid connection between said pivot clamp and said tensioners and said heaving lug and said guitar strings;

inserting a selected guitar string across said upper intonation point nut and into a bore formed between said lower end of said heaving lug and said longitudinal upper fin;

tensioning said string between said tremolo bridge and said heaving lug and said lug guide; and selectively adjusting said tension of a selective guitar string acted upon by said tremolo system by manipulating said selected tensioner and adjusting the positioning of said heaving lug within said lug receptacle of said lug guide.

* * * * *